United States Patent [19]

Mouissie

[11] Patent Number: 4,701,002

[45] Date of Patent: Oct. 20, 1987

[54] EDGE CONNECTOR WITH CLAMPING CONTACT ELEMENTS

[75] Inventor: Bob Mouissie, Berlicum, Netherlands

[73] Assignee: E. I. Du Pont de Nemours and Company, Wilmington, Del.

[21] Appl. No.: 3,476

[22] Filed: Jan. 15, 1987

[30] Foreign Application Priority Data

Jan. 30, 1986 [NL] Netherlands ..... 8600224

[51] Int. Cl.[4] ..... H01R 4/24

[52] U.S. Cl. ..... 439/426; 439/499; 439/630

[58] Field of Search ..... 339/17 F, 17 LC, 97 R, 339/97 P, 98, 99 R, 176 R, 176 M, 176 MP, 176 MF

[56] References Cited

U.S. PATENT DOCUMENTS

| | | | |
|---|---|---|---|
| 4,252,392 | 2/1981 | Whiteman, Jr. | 339/176 MF |
| 4,379,608 | 4/1983 | Olsson et al. | 339/75 |
| 4,533,202 | 8/1985 | Pohl | 339/176 MP |
| 4,579,404 | 4/1986 | Lockard | 339/176 MF |

*Primary Examiner*—Joseph H. McGlynn

[57] ABSTRACT

An edge connector is provided capable of interconnecting the conductors on a flexible conductor film and the conductors on one or more rigid substrates, such as for LCD or LED displays. The edge connector includes a plurality of clamping contact elements, each with at least three contact arms defining at least two insertion openings, one for the rigid substrates and one for flexible film. A fourth arm may be included to define a third insertion opening for a second rigid substrate.

21 Claims, 11 Drawing Figures fig-2
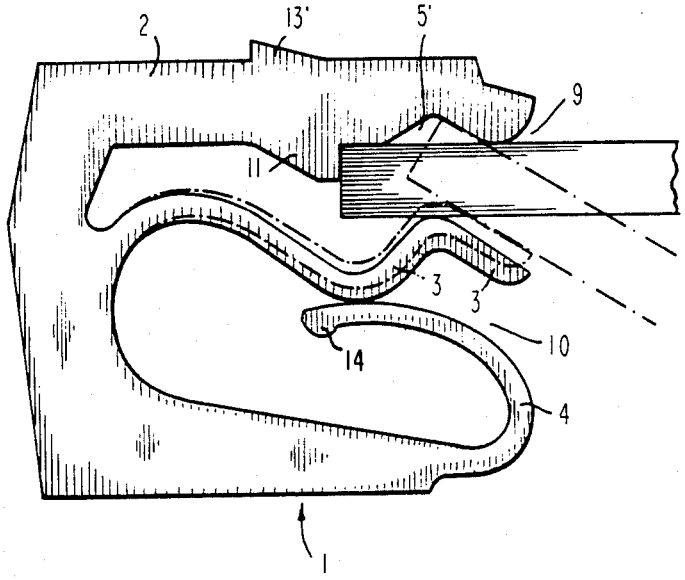
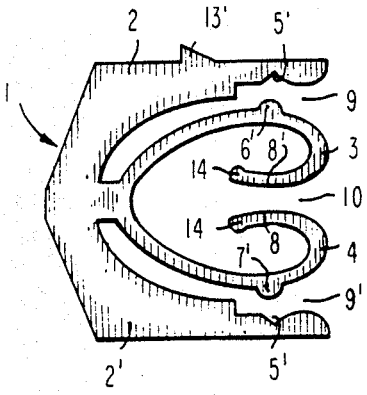
fig-3
fig-8
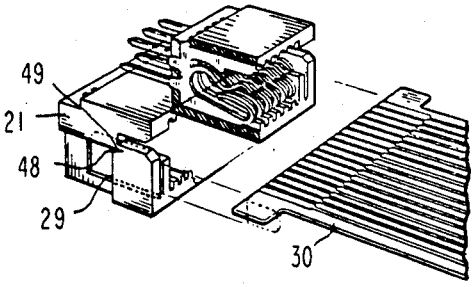

EDGE CONNECTOR WITH CLAMPING CONTACT ELEMENTS

BACKGROUND OF THE INVENTION

1. Field of the Invention

The invention relates to electrical connectors, and particularly to an edge connector for interconnecting flexible multiconductor film with LCD or LED display substrates.

2. Description of Related Art

For a number of years now, it has been common practice to use flexible conductor film for interconnecting electronic equipment and units. Such flexible conductor film may be made, for example by etching a copper layer applied to a polyester film serving as a carrier to produce an assembly of several, flexible parallel conductors.

One special field of application is in connections of flexible conductor film with the glass substrates of LCD (liquid crystal display) or LED (light emitting diode) panels. Here, an electrical connection generally has to be produced between a number of parallel conducting strips on the substrate and the respective conductors of the flexible film.

LCD and LED display panels are currently designed in various forms and functions. They include, for example instrument panels in airplanes, cars and ships, and alphanumeric displays in telecommunication equipment. On the substrate of such panels, one or more different functions may be accommodated. These may include speedometer, tachometer, alimeter, as well as indication and warning texts. This means that such a substrate must be provided on its edges with a relatively large number of contact strips or pads. When such a substrate is connected to plug contacts soldered on a printed circuit board, the substrate can no longer be replaced without breaking the soldered connection of one or more plug contacts provided along the edges.

This problem can be avoided by providing the connections with the substrates by means of flexible conductor film. Flexible conductor film can also be etched as a printed circuit and thus also provides attractive possibilities for producing therewith the various externally required connections between the substrate and the equipment for controlling the various functions.

An electrical connector for applying a pressure connection of a flat cable to an LCD or other substrate is disclosed in U.S. Pat. No. 4,379,608 issued Apr. 12, 1983. In the connector of this patent an electrical connection between the contact pads on a glass LCD substrate and the parallel conductors of flexible flat cable is obtained by mechanically pressing the flexible conductors of the flat cable onto the substrate under external spring force. The quality of this connection is largely dependent on the construction elements, which have to ensure that the conductors of the flat cable are accurately positioned relative to the contact pads or strips on the substrate. Since the glass substrates generally possess fairly sharp edges, the thin conductors of the flat cable can easily be damaged. This is true even more in the case of connectors in which the flat cable or other flexible conductor film has to be folded over an edge of the substrate.

In other connections such as the so-called "Zebra" strips, conducting flexible strips are fitted as an intermediate between the contact strips of the display panel and, for example, a printed circuit board. Applying external mechanical pressure on the Zebra strips to produce an electrical connection between the display panel and the printed circuit board cannot be easily or quickly accomplished. Also, various separate auxiliaries such as contact frames, compression means and the like are necessary for positioning of the Zebra strips.

SUMMARY OF THE INVENTION

The object of the present invention is to eliminate the above disadvantages by providing an edge connector capable of connecting a flexible conductor film such as a flat multiconductor cable with the rigid substrate of an LCD or LED display panel. The flexible conductor film can be received without contact friction into the edge connector, and can be positioned therein n a simple manner. A reliable connection can then be made, without external mechanical compression means, between the contact strips on the rigid substrate and the respective conductors of the flexible film.

To accomplish the foregoing, the present invention provides for a clamping contact element which is approximately E-shaped in structure and has at least three contact arms projecting from a base part. These include in order a fixed arm, a first spring arm and a second spring arm. The fixed arm and the first spring arm define a first insertion opening and the first and second spring arms define a second insertion opening. The insertion of a rigid substrate into the first insertion opening will cause the first spring arm to be pressed away and exert a pressure force on a flexible thin conductor which has been previously inserted without contact friction into the second insertion opening. In this way, an electrical connection is achieved between the flexible thin conductor and at least another conductor on, for example, the rigid substrate.

In one preferred embodiment of the invention, the second spring arm is of a shape which is bent backward from the insertion end, and the first spring arm is a meander or wave-like shape with at least one pressure face in the first insertion opening and another pressure face in the second inserting opening.

Another preferred embodiment of the invention includes a second fixed arm which is disposed following the second spring arm to thereby define a third insertion opening between the second spring arm and the second fixed arm. A second rigid substrate can be inserted into the third insertion opening by means of which the second spring arm is pressed away and exerts a pressure force on the previously inserted flexible thin conductor in the direction of the first spring arm.

In yet another preferred embodiment of the invention, the first and second spring arms are each of a shape which is bent over from the insertion side towards each other and backwards.

In another preferred embodiment of the invention, the fixed arm has near its end a V-shaped notch facing the particular insertion opening, in such a way that the corresponding rigid substrate is inserted at an angle with the fixed arm until its insertion edge lies in the V-shaped notch and is then introduced with low contact friction with lever action on the adjacent spring arm parallel to the fixed arm. The fixed arm is preferably provided with a stop, against the flat side of which the conductor or a conductor carrier introduced into the first insertion opening lies in the resting position.

In addition to a connection between, for example, a contact strip on a substrate and a conductor on a flexible film, it may also be necessary to connect the clamping contact element directly to, for example, signal wires or a printed circuit board. The clamping contact element according to the invention is to this end provided with molded-on means for the electrical connection of the clamping contact element to external connection means.

For the connection of several parallel thin conductors of preferably a flexible film with several parallel contact strips on a rigid substrate, provision is made according to the invention for an edge connector provided with several clamping contact elements accommodated in rows in a common housing of insulating material. Several clamping contact elements are disposed in the edge connector in such a way that the first and third insertion openings form a row for the insertion of the first and second substrate respectively and the second insertion openings form a row for the insertion of the flexible conductor film, while the electrically separate clamping contact elements achieve an electrical connection between the conductors contacted with the same clamping contact element.

A disadvantage of the edge connector disclosed in the aforenoted U.S. Pat. No. 4,379,608 is in the positioning and retaining of the flexible conductor film in a particular position so that a reliable and absolute contact is made between a conductor of the flexible conductor film and, for example, a contact strip on the rigid substrate. Since an object of the invention relates to the production of means for positioning the flexible conductor film in the row of second insertion openings, a preferred embodiment of the edge connector according to the invention provides the means for positioning the parallel conductor film. These include a rectangular recess which is disposed on each short side of the common housing and which by means of a groove-shaped connection channel is in its interior spatially connected to a groove-shaped opening which is positioned essentially transversely to the rows of insertion openings and which is accessible from the insertion side. The positioning means further provides that the flexible conductor film has a pre-worked end with projecting resilient, bendable projections on either side of film. Each such projection can flap outwards into a recess, after the insertion into the respective groove-shaped opening and can be held in that position by the rear face of the short side of the housing which projects sideways relative to the recess. As a result, the parallel conductors of the flexible conductor film are positioned between the respective second insertion openings and the film in its entirety is held in position in the common housing.

In another preferred embodiment of the edge connector, the common housing of the edge connector has on the insertion side defined insertion openings. The flexible conductor film and a first or second rigid substrate are inserted through these openings into the rows of insertion openings defined by the contact elements.

In yet another preferred embodiment of the edge connector, the rear face of the short side of the common housing, which projects sideways relative to the recess, has at the level of the row of second insertion openings a V-shaped notch facing the recess. In this manner, the projections of the film can each be positioned in the notch.

The common housing can also be provided with locking means for locking an external connection means on the housing. Such external connection means may be, for example, any suitable connector.

The edge connector according to the present invention can also be used advantageously as a connector for the insertion without contact friction and the connection of parallel thin conductors of a flexible conductor film. To do this, the clamping contact elements of the edge connector are provided with molded-on means for contacting the elements with external connection means. Into the row of first and third insertion openings, a first and second rigid substrate of insulating material may then be introduced respectively. This provides an electrical connection between a conductor in one of the clamping contact elements of, for example, a flexible conductor film and an external conductor contacted with said clamping contact element.

The clamping contact element can be punched advantageously from a piece of electrically conducting sheet material, while the common housing is preferably of cast insulating material. This means that the clamping contact units according to the invention can be mass-produced in an inexpensive and simple manner.

BRIEF DESCRIPTION OF THE DRAWINGS

The invention will now be explained in greater detail with reference to the embodiments shown in the drawings.

FIG. 2 is a side view of another preferred embodiment of a clamping contact element according to the invention;

FIG. 3 is a side view of yet another preferred embodiment of a clamping contact element according to the invention;

FIG. 8 is another embodiment of an edge connector according to the invention, with notches provided therein for accommodation of the projections of the flexible conductor film;

DESCRIPTION OF THE PREFERRED EMBODIMENTS

Figure 1:
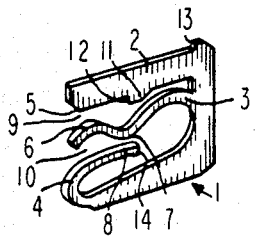
FIG. 1 is a perspective view of one preferred embodiment of a clamping contact element according to the invention.

The clamping contact element 1 of FIG. 1 has a fixed arm 2, a first spring arm 3 and a second spring arm 4, which are all connected to a base part and arranged in a virtual E-shaped element. The contact face 5 of the fixed arm 2 and the top pressure face 6 of the first spring arm 3 form a first insertion opening 9, while the bottom pressure face 7 of the first spring arm 3 and the contact face 8 of the second spring arm 4 form a second insertion opening 10. The two contact faces 5 and 8 are electrically connected to each other by means of the fixed arm 2, the second spring arm 4 and the base part of the clamping contact element. The insertion openings 9 and 10 are on the insertion side of the clamping contact element 1. The second spring arm 4 has a shape which is bent backwards from the insertion opening 10. The first spring arm 3 meanders in a wave-like shape so that its free end on the side with the insertion openings is bent slanting downwards. The top pressure face 6 is on a peak of the spring arm 5 while the bottom pressure face 7 is on a dip, positioned toward the rear, of the wave-like shape. The peak following this dip, viewed from the insertion openings, is connected to the base part of the clamping contact element 1.

With the insertion of a rigid substrate into the first insertion opening 9, the first spring arm 3 will be biased downwards, thereby causing its bottom pressure face 7 to exert a pressure force on whatever may be inserted into the second insertion opening 10, such as a thin conductor. The second spring arm 4 will also be biased downward, depending upon the amount of downward bias on the first spring arm 3. To prevent spring arm 4 from being bent too much, a downward-directed boss 14 can be formed on the side of spring arm 4 which faces away from the contact face 8.

The opening between the bottom pressure face 7 of the first spring arm 3 and the contact face 8 of the second spring arm 4 is dimensioned so that a conductor can be inserted between them without contact friction when the first insertion opening is free or empty. This is particularly important for a flexible conductor or a flexible conducting strip, since these cannot withstand pressure forces in the lengthwise direction. The bare side of the flexible conductor or conducting strips will thereby be brought into contact with the contact face 8 of the second spring arm 4. The bare side of a conductor or conducting strip of a substrate to be inserted into the first insertion opening 9 must be brought into contact with the contact face 5 of the fixed arm 2. The first spring arm 3 must thereby ensure sufficient contact pressure for a reliable electrical connection between these contact faces and the respective conductors.

As can be seen in FIG. 1, the fixed arm 2 is provided with a downward-facing stop 11. A conductor or conductor-carrying substrate inserted into the first contact opening 9 will in its resting position abut against the flat side 12 of the stop 11.

An upward-projecting boss 13 formed on the top side of the fixed arm 2 of the clamping contact element serves to hold the clamping contact element. This boss serves to hold the clamping contact element in a casing of, for example, plastic material which may surround around the clamping contact element.

FIG. 2 shows a side view of the clamping contact element of FIG. 1. In this embodiment, however, the fixed arm 2 has a V-shaped notch 5' near its free end facing the insertion opening 9.

The substrate is introduced into the insertion opening 9 at an angle with the fixed arm 2, until its forward, insertion edge lies in the V-shaped notch 5' as shown by the dotted line in FIG. 2. If the substrate is then rotated and brought to a position parallel the fixed arm 2 (as shown by the solid lines in FIG. 2) its lever action will move the first spring arm 3 downwards, thus enabling the substrate to be inserted further with low contact friction into the first insertion opening up to the stop 11.

The push-on force of the clamping contact element of FIG. 2 is considerably smaller than that with the clamping contact element of FIG. 1. This is because the spring force of the first spring arm 3 is now virtually overcome by means of the lever action of the inserted substrate. The clamping contact element according to this embodiment is provided on the top side with a boss 13' which retains the contact element in a casing of, for example, plastic material which may be provided around the contact element. Depending on the shape of the casing, a boss 13 like that in the embodiment of FIG. 1 can be used instead of a boss 13'. Likewise, the clamping contact element of FIG. 1 can be provided with a boss 13' instead of 13.

FIG. 3 shows another embodiment of a clamping contact element 1, with first and second fixed arms 2 and 2', respectively, projecting from a base portion. The second fixed arm 2' and a second spring arm 4 form a third insertion opening 9'.

The first and second spring arms 3 and 4 of FIG. 3 are in a form bent towards each other and backwards from the insertion side. The second spring arm 4 is provided with a contact face 8 and the first spring arm 3 with a contact face 8'. The two spring arms form the second insertion opening 10. Bosses 14 can be provided at the free ends of spring arms 3 and 4 to prevent buckling of the two spring arms. On the side facing their respective fixed arm, the spring arm have pressure lobes 6' and 7' facing the first and third insertion openings 9 and 9', respectively.

With the introduction of a first rigid substrate into the first insertion opening 9 and a second rigid substrate into the third insertion opening 9', the contact faces 8' and 8 of the spring arms 324 are pressed towards each other, so that a thin conductor, previously inserted without contact friction into the second insertion opening 10, is electrically connected to the clamping contact element 1 and the conductors to be contacted with it.

Like the clamping contact elements in FIGS. 1 and 2, the clamping contact element of FIG. 3 can also be provided with bosses 13 or 13' to retain the clamping contact element in a casing of, for example, plastic material.

The clamping contact element of FIG. 3 can also be designed without the V-shaped notches 5' in its fixed arms 2 and 2', similar to the fixed arm of the clamping contact element shown in FIG. 1.

Figure 4:
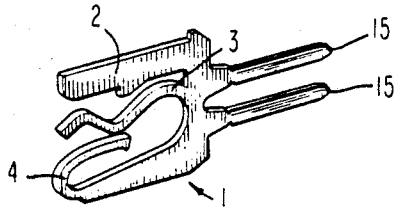
FIG. 4 is a perspective view of the clamping contact element of FIG. 1, with backward projecting pins for contacting the clamping contact element with external connection means.

As noted above, the clamping contact element can also be provided with means for direct electrical connection of the clamping contact element to, for example, signal wires, plug connections, printed circuit boards etc. FIG. 4 shows another embodiment of the contact element of FIG. 1 for this purpose, wherein backward-projecting pins 15 of electrically conducting material are molded onto the base part. Plug sockets can be pushed over the pins 15, or the pins can be, for example, soldered to a printed circuit board.

Figure 5:
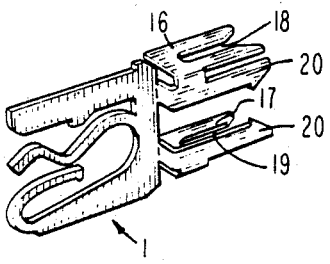
FIG. 5 is a perspective view of the clamping contact element of FIG. 1, provided with one or more plug contacts for contacting the clamping contact element with external connection means.

FIG. 5 shows another embodiment of the clamping contact element of FIG. 1 wherein the base part is provided with two molded-on plug contacts 16 and 17 of electrically conducting material. These plug contacts can be designed as insulation-displacement contacts. The conductors introduced into the contact channels 18 and 19 are brought into direct electrical connection with the clamping contact element 1 by means of these plug contacts 16 and 17.

Formed on the plug contacts 16 and 17 are two resilient hooks 20 facing each other. These hooks 20 can mate with parts fitted over the plug contacts and containing the signal wire(s) which have to be electrically connected to the clamping contact element 1, in such a way that these parts are retained over the plug contacts.

The two plug contacts 16 and 17 need not be the same shape or of the same dimensions. This makes it possible to connect signal wires of different diameters.

It will be clear that the embodiments of the clamping contact elements shown in FIGS. 2 and 3 can also be provided with pins 15 or plug contacts 16 and 17 in the same way as the clamping contact element of FIG. 1.

The individual clamping contact elements can be combined and arranged parallel to one another and electrically separate from one another to form an edge connector. This is done by forming a row of first insertion openings and parallel rows of second insertion openings and, where applicable, third insertion openings thereunder. All rows of insertion openings can accommodate several parallel conductors, as shown in the partially cutaway embodiment of the edge connector housing 21 in FIG. 6. In this embodiment, clamping contact elements such as those of FIG. 4 are accommodated in parallel groove-shaped recesses 22 in a common edge connector housing 21 of electrically insulating material. The pins 15 project outwards on the rear side of the common housing 21, on the side opposite the insertion openings. It is, of course, also possible to use the clamping contact elements according to the embodiment of FIGS. 2 or 3, with or without pins 15 or plug contacts 16 and 17.

The distance between the individual clamping contact elements corresponds to a pitch distance of 0.635 mm or more, common for this type of application, for clamping contact elements without means for connection of external conductors to be contacted. The pitch distance may be 1.27 mm or more for clamping contact elements with molded-on pins, and 2.54 mm or more for clamping contact elements with molded-on plug contacts.

Figure 6:
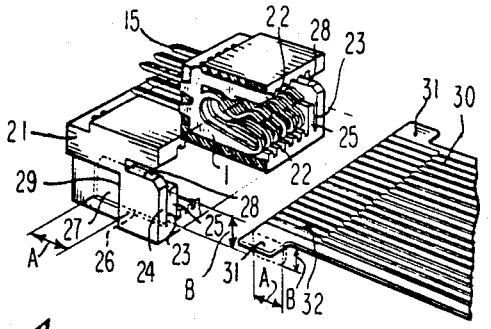
FIG. 6 is a perspective view in partial section of a preferred embodiment of an edge connector according to the invention, in which the clamping contact elements according to FIG. 4 are used, and shows the pre-worked end of the flexible conductor film.
Figure 7:
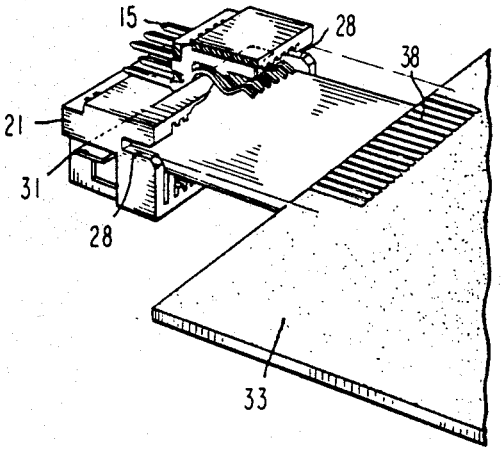
FIG. 7 is a perspective view of the edge connector according to FIG. 6 with a flexible conductor film retained therein and the substrate to be inserted.

The housing 21 is open at the front for inserting a flexible conductor film 30 with parallel conductors into the row of second insertion openings as shown in FIG. 6. A rigid conductor-carrying substrate 33 on which are disposed a number of parallel contact strips 34 may be inserted, into the row of first insertion openings, as shown in FIG. 7.

In order to permit correct positioning of the contact strips 32 of the flexible conductor film 30 between the second insertion openings 10 of the respective clamping contact elements 1, provision is made on each narrow side 24 of the common housing 21 for a recess 27. This recess lies inwards relative to the narrow side of the housing and is spatially connected by means of an internal groove-shaped connection channel 26 to a groove-shaped opening 23. The latter groove-shaped opening is positioned transversely to the row of first and second insertion openings and is formed by the narrow side 24 of the common housing 21 and a partition 25 which is placed parallel thereto but at a distance therefrom in the inward direction.

The flexible conductor film 30 is provided at its front or insertion end with resilient, bendable projections 31 projecting on either side and with respective dimensions A, B. The film is introduced without contact friction into the second insertion openings 10 by bending the projections 31 downwards into a position transverse to the plane of the film 30, as shown by dotted lines in FIG. 6, and by taking them in this position into the groove-shaped opening 23. If the film is taken further into the common housing 21, the projections by means of the connection channels 26 reach the recesses 27, in which they can spring back into their original position (see FIG. 5). To this end, the dimensions A and B of the recesses 27 correspond to the dimensions of the projections 31. The projections 31 are locked in this position by the rear faces 29 of the narrow sides 24 projecting sideways relative to the recesses 27. The film is retained in this way positioned in the correct manner between the row of second insertion openings in the common housing 21. The film can be removed again simply by extending sideways in the recesses 27 while the contacts are open and removing them through the conductor channels 26 from the housing.

During both the insertion and the removal of the parallel conductor film, no friction forces are exerted on the conducting strips, because the row of second insertion openings is then open. The chance of damage to the generally very thin contact strips is thus very small.

FIG. 8 shows an edge connector similar to that of FIG. 6 or 7. On the two rear faces 29 which project sideways relative to the recesses 27, there is provided, at the same level as the second insertion openings, V-shaped notches 48 facing the recesses. One side 49 of each notch is parallel to a surface of the inserted flexible conductor film or the rigid substrate.

After insertion of the flexible conductor film, the projections 31 of the film will fall into the notches, which will prevent sideways movements of the film in the row of second insertion openings. The reliability of the connections is thereby greatly increased.

Figure 9:
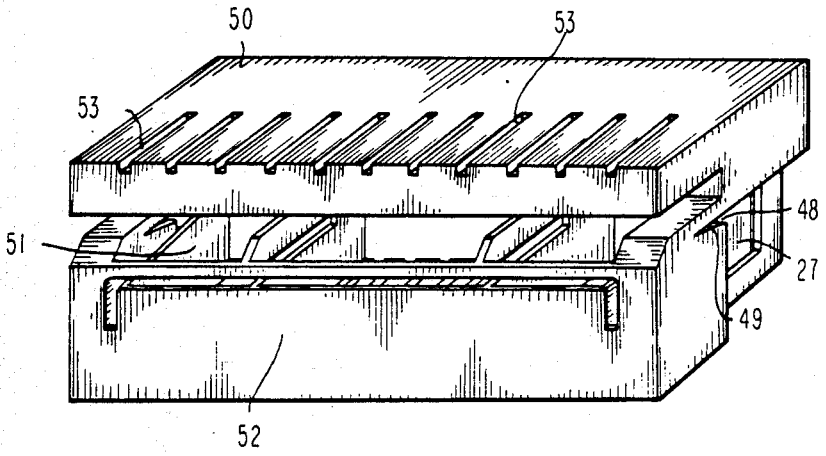
FIG. 9 shows a perspective view of a preferred embodiment of an edge connector according to the invention, viewed from the insertion side, with defined insertion openings for a rigid substrate and a flexible conductor film.

FIG. 9 shows yet another embodiment of an edge connector 50 according to the invention. Disposed on the insertion side are now defined openings for the rigid substrate 51 and the flexible conductor film 52. The thicker substrate cannot be fed inadvertently into the row of second insertion openings 52, which could lead to faulty contacts and damage to the spring arms.

Figure 10:
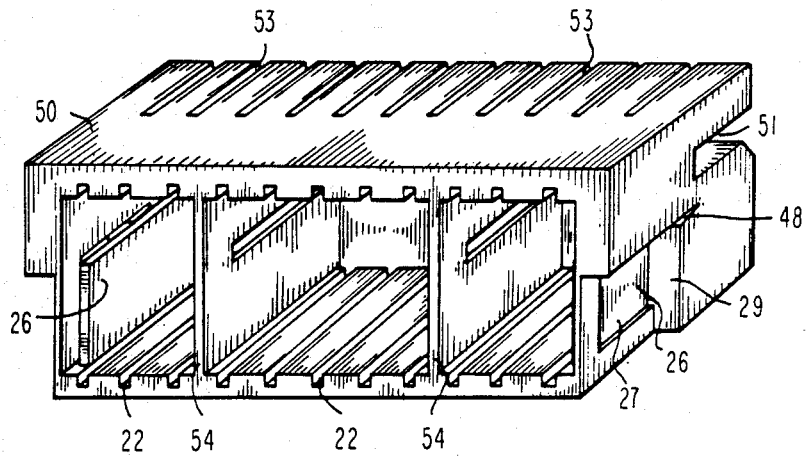
FIG. 10 is a perspective view of the edge connector according to FIG. 9 viewed from the rear side.

As can be seen in FIG. 10, the rear side of the common housing is open. The clamping contact elements are fitted from the open rear side into the parallel groove-shaped recesses 22 of the housing. By means of the boss 13' they are then retained in the parallel groove-shaped recesses 22, after fitting, by the recesses 53 provided on the top side of the common housing.

Figure 11:
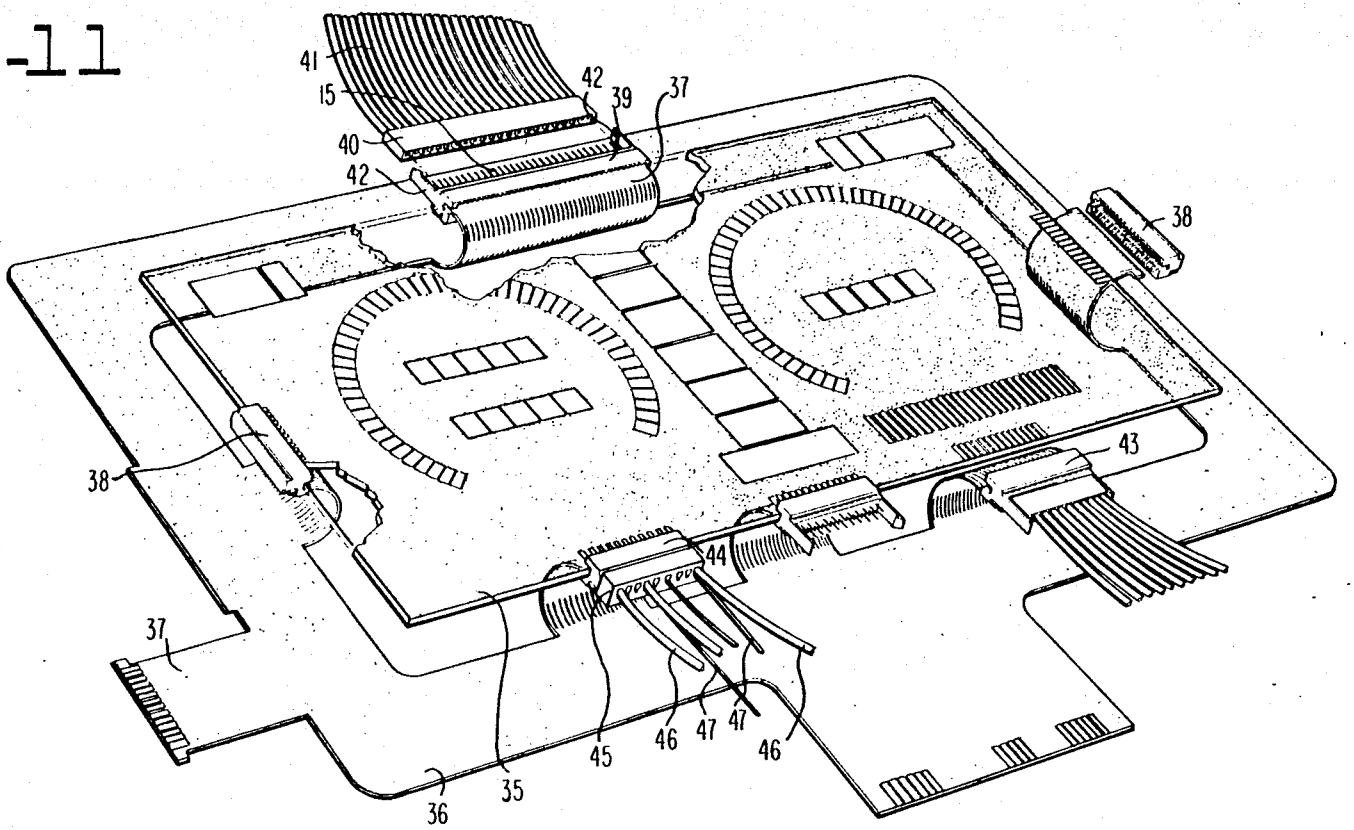
FIG. 11 shows an example of an application of various embodiments of an edge connector according to the invention.

In contrast to the edge connectors shown in FIGS. 6, 7 and 8 which have open insertion sides, the embodiment of FIGS. 10 and 11 has the advantage that during fitting of external connection means, for example via the pins 15, the clamping contact elements cannot be pressed out of the housing at the front. Reinforcement walls 54 can be provided in the common housing parallel to the clamping contacts to further strengthen the connector.

FIG. 11 shows an example of an application of the edge connectors according to the invention. A liquid crystal display panel 35 is provided along all its edges with several parallel contact strips. The flexible printed circuit 36 contains several pre-worked projections 37 which are to be connected to the respective contact strips on the liquid crystal display panel 35 by means of the edge connector according to the present invention.

Various embodiments of edge connectors according to the invention are shown in FIG. 11. The edge connector 38, for example, is provided with clamping contact elements according to FIG. 1 and serves only to connect the flexible circuit 36 with the panel 35.

The edge connector 39 is made up of clamping contact elements according to FIG. 4. Pushed over the backward-projecting pins is a standard, commercially available socket connector 40 interconnecting the contact elements or contact strips on the printed circuit 36 and the panel 35 to a flat ribbon cable 41. The housing of the edge connector 39 is provided with two resilient hook-shaped locking projections 42 for locking the connector part 40 on the housing 39, as illustrated by the mounted assembly 43.

The edge connector 44 is designed with clamping contact elements according to the embodiment of FIG. 5. From the openings on the rear side of the another connector 45 is attached to the rear of edge connector 44. This other connector 45 is retained by the locking hooks 20 of clamping contact elements 1 of FIG. 5. The signal wires 46 and 47 electrically extend from the rear of connector 45, and are connected to the clamping contact elements by means of plug contact 16 and 17. As can be seen, signal wires 46 are thicker than signal wires 47, which corresponds to different dimensions of the plug contacts 16 and 17. It should be understood that the display panel 35 can include of a rigid printed circuit board, which may or may not be provided with electronic components.

A major advantage of the invention is that the sharp edges along the display panel will not cause damage to the thin contact strips of the flexible conductor film. This is because the panel and the film are not brought into direct contact with each other, but are in contact through separate insertion openings of the respective clamping contact elements and the sequence of insertion.

The present invention is not limited to the embodiments described above and shown above in the figures, but that modifications and additions are possible without going beyond the scope of the invention.

I claim:

1. A contact element for electrically interconnecting a flexible multiconductor film and a rigid substrate, said contact elements comprising a fixed arm, a first spring arm and a second spring arm, all extending from a base portion to define approximately an E-shaped structure, said first spring arm being disposed between said fixed arm and said second spring arm;

a first insertion opening formed between said fixed arm and said first spring arm adapted to receive said rigid substrate; and a second insertion opening formed between said first and second spring arms adapted to receive a flexible thin conductor of said flexible multiconductor film, whereby the insertion of said rigid substrate into the first insertion opening will bias the first spring arm to exert a pressure force on the flexible thin conductor which has been previously inserted without contact friction force into the second insertion opening, thereby achieving electrical interconnection between the flexible thin conductor and at least one conductor on said rigid substrate.

2. A contact element according to claim 1, wherein the second spring arm has a shape which is bent backward from the insertion opening, and the first spring arm has a wave-like shape with at least one pressure face presented toward the first insertion opening and another pressure face presented toward the second insertion opening.

3. A contact element according to claim 1, wherein the fixed arm has a V-shaped notch near its free end facing the first insertion opening, so that when the rigid substrate is inserted at an angle to the fixed arm, the insertion edge of said substrate will abut and lie in the V-shaped notch, and said substrate is then capable of further insertion with low contact friction, said substrate exerting a lever action on the first spring arm until the substrate is parallel to the fixed arm.

4. A contact element according to claim 1, wherein the fixed arm has a stop against a flat side facing the first insertion opening, said stop abuting the inserted rigid substrate.

5. A contact element according to claim 1, further comprising a second fixed arm disposed on the other side of the second spring arm and a third insertion opening formed between said second spring arm and said second fixed arm and which is adapted to receive a second rigid substrate, whereby insertion of said second rigid substrate will bias the second spring arm towards the first spring arm to exert a pressure force on the previously inserted flexible thin conductor.

6. A contact element according to claim 5, wherein the first and second spring arms each have a shape which is bent towards each other and backwards from the insertion openings.

7. A contact element according to claim 1, further comprising additional contact means projecting from the other side of the base portion for contacting one or more other conductors.

8. A contact element according to claim 7, wherein said additional contact means are backward-projecting pins made of electrically conducting material.

9. A contact element according to claim 7, wherein said additional contact means are plug contacts made of electrically conducting material and having either the same or different dimensions.

10. A contact element according to claim 9, wherein one or more of said plug contacts are insulation-displacement contacts.

11. A contact element according to claim 9, wherein the base portion is provided with locking means for retaining an external connection means.

12. A contact element according to claim 11, wherein said locking means comprises two backward-projecting resilient hooks facing each other.

13. An edge connector for electrically interconnecting a plurality of parallel conductors disposed on a flexible conductor film and a plurality of other conductors on a ridge substrate, said edge connector comprising:

a housing of insulating material, a plurality of contact elements disposed in a row in said housing, each said contact element having at least three contact arms;

a first row of first insertion openings defined by a first and second contact arm of each said plurality of contact elements, each first row of insertion opening adapted to receive a rigid substrate; and a second row of second insertion opening defined by a second and third contact arm of each of said plurality of contact elements, said second row of insertion openings adapted to receive said flexible conductor film;

whereby insertion of said rigid substrate into said first row of insertion openings causes a pressure force to be exerted on the flexible conductor film which has been previously inserted into the second row of insertion openings, thereby achieving electrical interconnection between the conductors on said flexible film and the conductors on said substrate.

14. An edge connector according to claim 13, wherein each said contact element has at least four contact arms, thereby providing a third row of third insertion openings, said third row being adapted to receive a second rigid substrate.

15. An edge connector according to claim 13, wherein means are provided for positioning of the flexible conductor film introduced into the second row of second insertion openings.

16. An edge connector according to claim 15, wherein the means for positioning the flexible conductor film includes a rectangular recess which is disposed on each side of said housing, said rectangular recess being spatially connected by means of a groove-shaped connection channel to a groove-shaped opening which is positioned essentially transversely to the rows of insertion openings, said recess being accessible from the insertion side.

17. An edge connector according to claim 16, wherein said flexible conductor film has a pre-worked end which has on either side resilient, bendable projections, each said projection adapted to be received into a respective rectangular recess after the insertion into the respective groove-shaped openings, said projections adapted to be retained by the rear face of said side of the housing which projects sideways relative to said rectangular recess, whereby said parallel conductors of the flexible conductor film can be positioned between the respective second insertion openings, and said flexible film is entirely held in position in said housing.

18. An edge connector according to claim 17, wherein the housing of the edge connector has on its insertion side defined insertion apertures into which the flexible conductor film and a rigid substrate may be inserted into their respective rows of insertion openings.

19. An edge connector according to claim 17, wherein the rear face of the said side of the housing which projects sideways relative to said recess has at the level of the second row of second insertion openings a V-shaped notch facing said recess, thereby enabling each of the projections of the flexible conductor film to be positioned in said notch.

20. An edge connector according to claim 15, wherein the housing is provided with locking means for latching an external connection means onto the housing.

21. An edge connector according to claim 20, wherein said locking means are formed by two resilient hook-shaped locking projections which are disposed on said sides of the housing and can mate with said external connection means.

* * * * *